US010287799B2

(12) United States Patent
Nicoara et al.

(10) Patent No.: US 10,287,799 B2
(45) **Date of Patent: *May 14, 2019**

(54) LOCK

(71) Applicant: RAV BARIACH (08) INDUSTRIES LTD, Ashkelon (IL)

(72) Inventors: Peter Nicoara, Ashdod (IL); Eran Goldstein, Givatayin (IL)

(73) Assignee: RAV BARIACH (08) INDUSTRIES LTD., Ashkelon (IL)

( * ) Notice: Subject to any disclaimer, the term of this patent is extended or adjusted under 35 U.S.C. 154(b) by 204 days.

This patent is subject to a terminal disclaimer.

(21) Appl. No.: 14/736,047

(22) Filed: Jun. 10, 2015

(65) Prior Publication Data

US 2016/0362912 A1 Dec. 15, 2016

(51) Int. Cl.
*E05B 27/00* (2006.01)

(52) U.S. Cl.
CPC ..... *E05B 27/0021* (2013.01); *E05B 27/005* (2013.01)

(58) Field of Classification Search
CPC ..... E05B 27/005; E05B 27/0021; E05B 27/0053; E05B 35/10
USPC ..... 70/358, 359, 337–343, 382–385, 70/493–495, 378, 392, 409, 419, 421, 70/DIG. 22, DIG. 29, DIG. 44, DIG. 71, 70/DIG. 75
See application file for complete search history.

(56) References Cited

U.S. PATENT DOCUMENTS 2,194,469 A * 3/1940 Fremon ..... E05B 27/005 70/378
2,232,017 A * 2/1941 Wilder ..... E05B 27/005 70/378
2,232,137 A * 2/1941 Rolph ..... E05B 27/005 70/378
3,320,781 A * 5/1967 Hill ..... E05B 27/005 70/378
3,589,153 A * 6/1971 Hill ..... E05B 27/005 70/378
3,667,262 A * 6/1972 Hill ..... E05B 27/00 70/341
3,802,234 A * 4/1974 Gerlach ..... E05B 27/0021 70/378
4,732,023 A * 3/1988 Shen ..... E05B 27/005 70/358
5,233,850 A * 8/1993 Schroeder ..... E05B 27/005 70/337
5,791,181 A * 8/1998 Sperber ..... E05B 27/005 70/383

(Continued)

*Primary Examiner* — Lloyd A Gall
(74) *Attorney, Agent, or Firm* — The IP Law Firm of Guy Levi, LLC

(57) ABSTRACT

A tumbler for positioning in a bore perpendicular to a keyway in a lock for selectively engaging a feature of a key within the keyway, wherein the tumbler comprises a male part that interlocks with a female part about a compressed spring; the male part having retaining teeth for selectively engaging an inner notch or an outer notch of the female part, such that when the retaining teeth engage the outer notch, the tumbler has a first configuration with an uncompressed overall length and on compression assumes a second configuration wherein the teeth of the male part engage the inner notch in the female section so that the overall length of the lock component is reduced, the change being irreversible.

13 Claims, 4 Drawing Sheets

(56) References Cited

U.S. PATENT DOCUMENTS 5,839,309 A * 11/1998 Fantl ..... B25B 5/06 225/2
5,966,971 A * 10/1999 Keller ..... E05B 27/0021 70/359
6,973,813 B2 * 12/2005 Erdely ..... E05B 29/004 70/377
7,448,239 B1 * 11/2008 Huang ..... E05B 27/005 70/340
7,634,931 B2 * 12/2009 Segien ..... E05B 27/0021 70/368
8,276,419 B2 * 10/2012 Farrenkothen ..... E05B 29/00 70/377
8,336,350 B2 * 12/2012 Nicoara ..... E05B 19/0023 70/395
8,347,678 B2 * 1/2013 Chong ..... E05B 27/005 70/340
8,646,299 B2 * 2/2014 Sloth ..... E05B 27/0014 70/358
2005/0217331 A1 * 10/2005 Williams ..... E05B 27/00 70/493
2006/0059965 A1 * 3/2006 Benstead ..... E05B 27/005 70/493
2007/0193317 A1 * 8/2007 Herdman ..... E05B 27/0057 70/383
2008/0236224 A1 * 10/2008 Chong ..... E05B 27/005 70/358
2009/0277236 A1 * 11/2009 Huang ..... E05B 29/004 70/368
2009/0277240 A1 * 11/2009 Huang ..... E05B 29/004 70/493
2012/0055212 A1 * 3/2012 Nicoara ..... E05B 19/0023 70/276
2013/0327102 A1 * 12/2013 Ben-Aharon ..... E05B 27/0042 70/493

* cited by examiner

LOCK

BACKGROUND

The present invention is directed to improvements to cylinder locks.

Cylinder locks consist of a stator or housing which is also known as a block, having a barrel for a rotor or cylinder (also known as plug) that rotates within the barrel. The lock is provided with tumblers which are pin-like elements that sit within a part of a radial bore hole that extends from the keyway in the rotor, crossing the rotor into the stator. The tumbler is positioned proximally to the keyway. The bore extends into the stator, and there is a second pin like element within the stator, that is biased towards the tumbler by a biasing spring that is held in place by a plug that blocks the distal end of the bore.

The perimeter of the cylinder, where it contacts the barrel is known as the shear line. To rotate the cylinder, none of the tumblers or driver pins may bridge the shear line. The features of the correct key within the keyway position the tumblers and drivers in the correct positions so that none bridge the shear line, enabling the key to be rotated, rotating the cylinder with it.

Rotating the cylinder with respect to the stator unlocks the lock and typically allows the retraction of one or more latches or bolts, allowing a door to be opened. This can only happen if all the tumbler pins are within the rotor and all the driver pins are within the stator such that no part of any pin bridges the divide between the stator and the cylinder. This is achieved by the proximal element or pin lying fully within the cylinder and the distal element or pin lying fully within the bore in the stator.

The cylinder is provided with a key way into which a corresponding key may be inserted. The corresponding key has protrusions or indentations that toggle the tumblers and align their ends with the shear line, i.e. the perimeter between the stator and cylinder to allow the cylinder to be rotated.

In general, the more tumblers that are provided, the better the lock and the more difficult it is to force since the number of key options increases exponentially with the number of tumblers.

The key may have a jagged edge, as common in Yale® locks, a cylindrical shank as common in Chub® locks, or a flat key with indentions as is common in Rav Bareach® locks.

Rav Bareach® have a well deserved reputation for their quality locks. The Rav Bareach® lock is a cylinder lock that is opened using a flat blade dimpled key. Each dimple engages and toggles a different tumbler. The depth and position of the dimples provides different key-lock combinations. In high security locks, the shape of the depressions may also vary.

Mul-T-lock has developed the so-called 3 in 1 system wherein a lock is provided with three color coded keys, typically red, yellow and green. The green key is the basic one for opening the lock as provided. Insertion and turning of a yellow coded key causes the end of one or more pins to break and changes the configuration of the lock so that the red key will no longer open it, with the yellow key becoming the key for the lock. This provides a convenient way to change the configuration of a lock twice, without having to remove and change the lock cylinder.

There are various improvements and variations to this type of lock-key combination. For example, USSN 2012/0055212 to Nicoara provides a further layer of sophistication to Rav Bariach's lock and key combinations, by providing flat blade keys mutually compressible actuating elements, that are essentially telescopic studs that align with and compress the pins of a tumbler and which make duplicating the key more difficult. The pins used are compound pins that include an inner pin and an outer pin housing. Both pin and outer pin housing have beveled edges that enable them to slide up and down as the key is inserted into the keyway.

There is an ongoing need to provide additional security features, and there is value in enabling locks to be reconfigured using a key, without having to change cylinders.

The tumblers that are pushed up into the bores of the stator by the key are sometimes known as pins. This term is appropriate if the element is a simple cylinder. In some locks, more sophisticated elements are provided. For example, in German Utility Design DE 202004015051 titled "Locking cylinder for door lock comprises a housing pin having a first pin part and a second pin part which slide into each other and a spring acting between the first and second pin parts for moving the pin parts", an element consisting of male and female components around a spring is shown—see FIG. 3 thereof. Insertion of the key causes the male component to be squeezed into the female component, compressing the spring. On removal of the key, the spring causes the male component to move with respect to the female component, restoring the overall length.

European patent number EP0763639 titled "Pin tumbler and lock cylinder with such a pin tumbler" also show a compressible element (referred to as a bolt) with an internal spring. The compressible element has a male component or shaft with a protruding ring referred to as a shaped outer ridge around the shaft, that can be moved in and out of a cylindrical housing or female component referred to therein as a mounting bore, with the protruding ring configured to slide within a circumferential indention referred to therein as a widened section, that keeps the male part (shaft) locked within the female part (mounting bore), but allowed the overall element to be compressed by applying a force that overcomes the resilience of the spring. On releasing the compressive force, the spring expands, forcing the male element (shaft) to slide outwards to assume its outer configuration, the protrusion being stopped by the end of the circumferential indentation. Sometimes these compressible elements are referred to as pins, but this is somewhat confusing.

https://www.reporteditor.com/reports/report/bc8b718491be21b8/publication1 titled "Key Operated Locks" describes a method of changing the effective lengths of the tumblers of a Yale™ type lock, using a special reconfiguring keys. The effective lengths of the tumblers may be shortened or lengthened.

U.S. Pat. No. 3,589,153 titled "Key Operated Lock" describes a key operated lock including a housing having a cylindrical bore therethrough in which a plug is rotatably mounted. Apertures extend radially outwardly in the housing from the bore and each slideably receives a driver. Each driver is aligned, in one position of the lock, with a tumbler assembly movably positioned in an aperture in the plug. The tumbler assembly—receiving apertures communicate with a main key slot in the plug, and insertion of a main key in this slot biases the several tumbler assemblies to a lock opening position in which the tumbler assemblies contact the drivers along a shear line lying in the interface between the plug and body. The tumbler assemblies are adjustable in their dimensions so that they may be altered to permit a new key to be made operative for opening the lock. Each tumbler assembly includes two relatively moveable parts which are interlocked by a locking pin until it is desired to alter the assembly's dimension for key changing purposes. The locking pins are cammed to the interlocking positions by cam plates. These cam plates line up with the driver apertures when the plug is rotated to a key changing position, and in this position, a change key can be inserted in a change key slot in the plug to bias each locking pin to a position in which the two relatively movable parts of each tumbler assembly are disengaged. The tumbler assemblies can then automatically accommodate their dimensions to an entirely different main key inserted in the main key slot. Thus a second key is required in a second key slot to reconfigure the main key.

U.S. Pat. No. 8,347,678 titled "Rekeyable Lock Cylinder Assembly" describes a rekeyable lock cylinder assembly includes at least one lock cylinder and a mortise lock adapter. Each lock cylinder includes a cylinder body with a longitudinal axis. A locking bar is disposed in the cylinder body for movement transverse to, and rotationally about, the longitudinal axis. A plug assembly having a tool receiving aperture is disposed in the cylinder body and is rotatable about the longitudinal axis. A plurality of pins and a corresponding plurality of racks are disposed in the plug assembly. A first member is moveable in response to application of a force by a tool received through the aperture to simultaneously disengage all of the plurality of racks from the plurality of pins. The mortise lock adapter includes a housing configured for receiving the cylinder body of the lock cylinder. A mortise lock actuator is coupled to the plug assembly of the lock cylinder.

U.S. Pat. No. 7,634,931 titled "Rekeyable Lock Cylinder Assembly With Adjustable Pin Lengths" describes a rekeyable lock cylinder includes a plug body and a backing rack that cooperate to define a plurality of pin chambers within the lock cylinder, with each of the pin chambers housing a corresponding pin. Movement of the backing rack changes the configuration of the pin chambers, thereby allowing the corresponding pins to change configuration to match the bitting on a valid key.

U.S. Pat. No. 4,732,023 titled "Modifiable Cylinder" describes a modifiable cylinder which comprises a plug and a cylinder body. The plug fits into the cylinder body and has a keyway and a plurality of bottom pin holes which are disposed above and perpendicular to the keyway. Each of the bottom pin holes has a bottom pin. The cylinder body comprises a main chamber housing and a subchamber housing. The main chamber housing has a plurality of top pin holes, each of which has a spring and a top pin. In open position, the top in hoes are aligned with the bottom pin holes. The subchamber housing has a plurality of top pin holes, each of which has a spring, a top pin and several discs. When the plug is turned to the modifying position, the top pin holes are aligned with the bottom pin holes so that the discs can be moved into the bottom pin holes so as to modify the inner combination of the cylinder.

European Patent Number EP 2,184,426 titled "Lock Cylinder, In Particular for a Door Lock" describes a lock wherein the closing cylinder has a housing containing a first spring acting on a housing pin and a core rotating in a cavity. A second spring is fitted between the first pin part and the second pin part. This spring is stressed in the direction of the core. The first pin part is in the form of a shell, and the second one has a widened end facing the core.

U.S. Pat. No. 3,802,234 titled "Pick-Resistant Lock Construction Including Jamming Feature" describes a keyed, pin tumbler type lock that has one or a series of jamming pin members in the casing intermediate the path of rotation of the lock cylinder between locked and unlocked positions. Attempted rotation of the lock cylinder from locked toward unlocked position without use of the key permits the jamming pin members to move inwardly partially into the lock cylinder jamming it against further rotation to the unlocked position. The jamming pin members are axially split pins outwardly axially abutted by spring urged wedge members which force the split pins partially into the lock cylinder pin openings while radially separating the split pins to engage them axially outward with casing shoulders, thereby permanently positioning the jamming pins in lock cylinder jamming position.

SUMMARY OF THE INVENTION

A first aspect is directed to a tumbler for positioning in a bore extending radially from a keyway in a lock for selectively engaging a feature of a key within the keyway, said tumbler comprising a male part that interlocks with a female part about a compressed spring; the male part having retaining teeth for selectively engaging an inner notch or an outer notch on inner surface of the female part, such that when said retaining teeth engage the outer notch, the lock component has a first configuration with an uncompressed overall length and on compression assumes a second configuration wherein the teeth of the male part engage the inner notch in the inner surface of the female section, so that the overall length of the tumbler is reduced, such that the reduction in length of the tumbler is irreversible.

In some embodiments, a plurality of inner notches are provided, and the tumbler is able to assume a plurality of shortened lengths.

The retaining teeth are locking such that the tumbler may be compacted, but once compacted, the tumbler may not be extended again.

Typically, the male and female parts each have a flat surface parallel to the keyway.

Typically, the male and female parts further comprise beveled edges around said flat surfaces.

Alternatively, the male and female parts have dome shaped outer surfaces.

Optionally, the tumbler further comprises an inner pin having a length equal to the combined length of the interlocked male and female parts when the teeth of the male part engage the inner notch of the female part and the lock component is compacted.

Optionally, the tumbler further comprises a filling disk such that the filling disk and the inner pin have a combined length equal to the combined length of the male and female parts when the teeth of the male part engage the outer notch of the female part and the lock component is not compacted.

A second embodiment is directed to a tumbler assembly comprising a tumbler, a driver, a spring and a plug within a bore; the tumbler for positioning in a bore perpendicular to a keyway in the lock for selectively engaging a feature of a key within the keyway, said tumbler comprising a male part that interlocks with a female part about a compressed spring; the male part having retaining teeth for selectively engaging an inner notch or an outer notch on inner surface of the female part, such that when said retaining teeth engage the outer notch, the lock component has a first configuration with an uncompressed overall length and on compression assumes a second configuration wherein the teeth of the male part engage the inner notch in the female section so that the overall length of the tumbler is reduced.

Typically, the male and female parts each have a flat surface parallel to the keyway and beveled edges around said flat surfaces.

Alternatively, the male and female parts each have dome shaped ends.

Typically, the male part is fabricated from a resilient, elastic material.

Typically, the resilient, elastic material is a metal alloy.

Optionally, the teeth of the male part have outer tapered surfaces and lower flat surfaces and the metal or alloy of the male part has a Young's modulus such that the teeth may be forced inwards to enable the tumbler to be compacted, but the compaction is irreversible.

In one embodiment, the tumbler comprises an inner pin having a length equal to the combined length of the interlocked male and female parts when the teeth of the male part engage the inner notch of the female part and the lock component is compacted.

Optionally, the tumbler assembly further comprises a filling disk such that the filling disk and the inner pin have a combined length equal to the combined length of the male and female parts when the teeth of the male part engage the outer notch of the female part and the lock component is not compacted, but on compacting, the filling disk is expelled out of the lock component into the bore.

A third aspect is directed to a lock comprising a cylinder configured to rotate within a barrel, and provided with a tumbler assembly, comprising a tumbler, a driver, a spring and a plug within a bore extending radially from a keyway in a lock for selectively engaging a feature of a key within the keyway, said tumbler comprising a male part that interlocks with a female part about a compressed spring; the male part having retaining teeth for selectively engaging an inner notch or an outer notch of the female part, such that when said retaining teeth engage the outer notch, the tumbler for assuming a first configuration with an uncompressed overall length and on compression assuming a second configuration wherein the teeth of the male part engage the inner notch in the female section so that the overall length of the tumbler is reduced, wherein the reduction in overall length of the tumbler is irreversible.

Optionally, the male and female parts each have a flat surface parallel to the keyway and beveled edges around said flat surfaces.

Alternatively, the male and female parts each have domed ends.

Optionally, the tumbler further comprises an inner pin having a length equal to the combined length of the interlocked male and female parts when the teeth of the male part engage the inner notch of the female part and the lock component is compacted; a filling disk such that the filling disk and the inner pin have a combined length equal to the combined length of the male and female parts when the teeth of the male part engage the outer notch of the female part and the lock component is not compacted, but on compacting, the filling disk is expelled out of the lock component into the bore, such that inserting a key having a shallow dimple into the keyway and rotating causes the beveled surfaces to press against barrel lock component to assume a compacted state and to expel the filling disk out of the lock component and into the bore.

In some embodiments, the lock further comprises a socket on opposite side of cylinder from tumbler bore, such that rotation of cylinder through a preset angle, causes the filling disk to be ejected out of the bore by the spring, and into the socket.

The preset angle may be 180°.

It will be appreciated that the lock may further comprise additional tumblers.

A fourth aspect is directed to a method of changing a key and lock combination of a lock comprising a cylinder configured to rotate within a barrel, by providing a tumbler within a bore extending radially from a keyway in a lock for selectively engaging a feature of a key within the keyway, said tumbler comprising a male part that interlocks with a female part about a compressed spring; the male part having retaining teeth for selectively engaging an inner notch or an outer notch of the female part, such that when the retaining teeth engage the outer notch, the lock component has a first configuration with an uncompressed overall length and on compression assumes a second configuration wherein the teeth of the male part engage the inner notch in the female section so that the overall length of the lock component is reduced, wherein the reduction in length of the tumbler is irreversible.

Optionally, the tumbler has a plurality of inner notches and may assume a plurality of reduced lengths.

Optionally, the male and female parts each have a flat surface parallel to the keyway and beveled edges around said flat surfaces.

Alternatively, at least one of the male and female parts has a domed end.

In some embodiments, the tumbler further comprises an inner pin having a length equal to the combined length of the interlocked male and female parts when the teeth of the male part engage the inner notch of the female part and the lock component is compacted.

Typically, the radially extending bore further includes a driver, a spring and a plug.

Optionally, the radially extending bore further comprises a filling disk such that the filling disk and the inner pin have a combined length equal to the combined length of the male and female parts when the teeth of the male part engage the outer notch of the female part and the lock component is not compacted, but on compacting, the filling disk is expelled out of the lock component into the bore.

The method of changing the key comprises inserting a key having at least one shallow dimple corresponding to a tumbler having a first lock component into the keyway and rotating the key to compact the first lock component, thereby ejecting the filling disk into the bore, such that on rotating the cylinder through the preset angle, the filling disk is transferred to the socket.

BRIEF DESCRIPTION OF FIGURES

For a better understanding of the invention and to show how it may be carried into effect, reference will now be made, purely by way of example, to the accompanying drawings.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention; the description taken with the drawings making apparent to those skilled in the art how the several forms of the invention may be embodied in practice. In the accompanying drawings.

DESCRIPTION OF EMBODIMENTS

Figure 1:
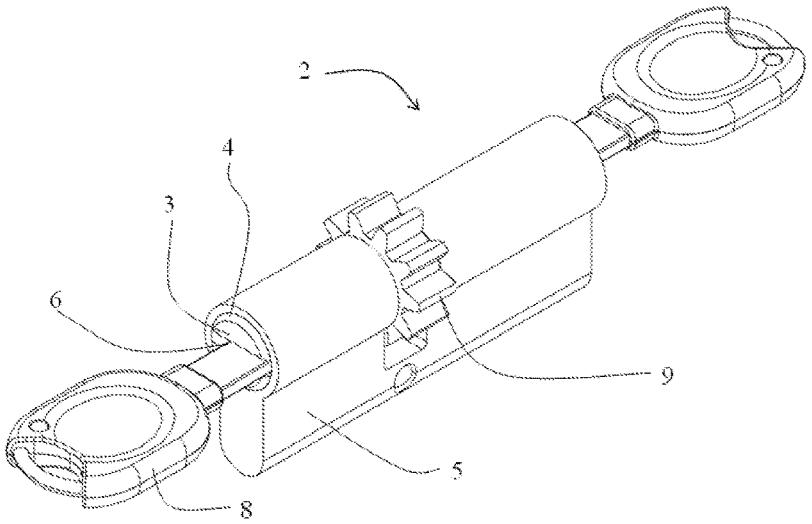
Fig. 1 (prior art)
FIG. 1 is a schematic representation of a lock housing or stator, having a pair of cylinders, each within a barrel, and corresponding keys.

With reference to FIG. 1, a cylinder block 2 is shown. The cylinder block 2 contains a pair of cylinder plugs 3 that each rotate within a barrel 4. There is a keyway 6 within the cylinder plug for a key. The barrel 4 is part of the stator 5. Rotating the key 8 causes the cylinder plug 3 to rotate within the barrel 4 and to turn a transmission element 9 that transfers the torque of the key to retract the latch or bolt of the lock (not shown).

Within the stator 5 or housing, are various bores that include pin like elements known as tumblers and driver pins. The key aligns the tumblers pins and drivers such that the joining edges thereof are aligned with the shear line between the cylinder and the barrel, allowing the cylinder plug 3 to rotate.

The present invention is directed to a novel type of lock component, known hereinbelow as a compactable tumbler.

Figure 2:
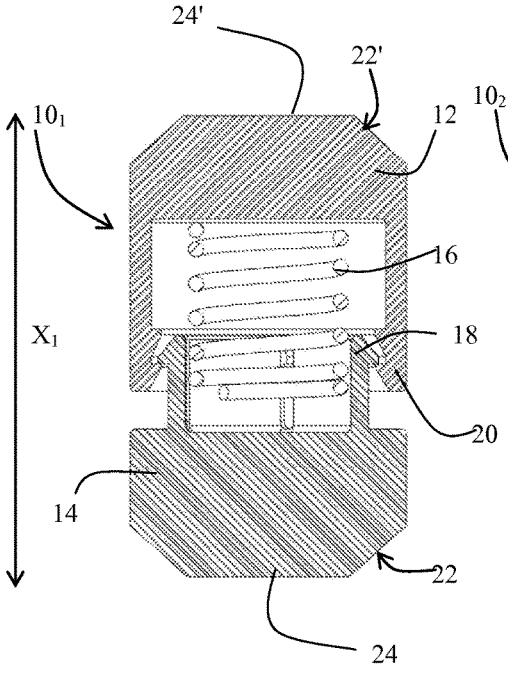
FIG. 2 is a sectional view of a compactable tumbler in its extended state.

With reference to FIG. 2 a sectional view of a compactable tumbler $\mathbf{10}_1$ is shown. Tumbler $\mathbf{10}_1$ is generally cylindrically shaped, and so its section, as shown is generally rectangular. Tumbler $\mathbf{10}_1$ consists of a first element 12 and a second element 14 coupled around a spring 16. One of the first element 12 and the second element 14 is provided with teeth 18 that engage a notch 20 in the other of the first element 12 and the second element 14. As shown, the lower element 14 is provided with teeth 18 and the upper element 12 is provided with a notch 20. It will be appreciated however, that compactable tumbler $\mathbf{10}_1$ is reversible, and the male element 14 with the teeth 18 may be provided on the top, and the female element 12 with the notch 20 may be provided on the bottom. As shown, the base 24 of the bottom element 14 is flat, and it is provided with a beveled edge 22. Similarly, the top element 12 has a flat base 24' surrounded with a beveled edge 22'. Alternatively, one or more of the flat base and beveled edge may be replaced with domed ends.

Figure 3:
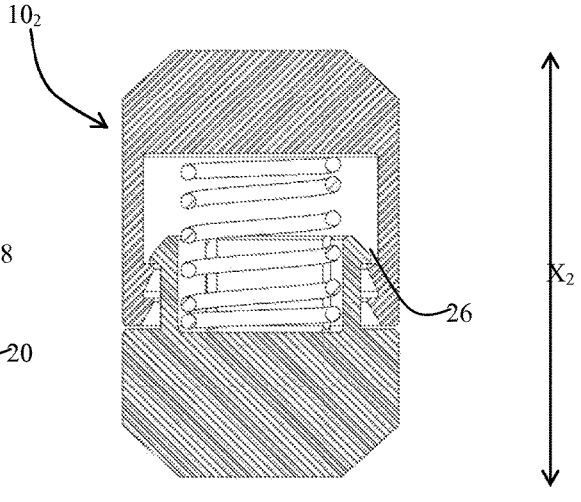
FIG. 3 is a sectional view of the compactable tumbler of FIG. 2 in a compacted state.

The overall length of the compactable tumbler $\mathbf{10}_1$ shown in FIG. 2, is $X_1$. On application of a compressive force to the compactable tumbler $\mathbf{10}_1$, distal component 12 is rammed into proximal component 14, and teeth 18 engage a second notch 26. The compactable tumbler $\mathbf{10}_1$ then assumes a compacted configuration $\mathbf{10}_2$ shown in FIG. 3, and has an overall length $X_2$ such that $X_2<X_1$.

Although shown with male, toothed component 14 on the lower element, and a female component 12 with notches 20, 26 as the upper element, it will be appreciated that compactable tumbler $\mathbf{10}_1$ may be inserted into a bore such that either element 12, 14 is proximal to the keyway. The male, toothed component 14 and its teeth 18 are generally fabricated from a resilient material, typically a metal or alloy such as brass, but possibly a ceramic or plastic having an appropriate degree of stiffness and resilience. The distal surface of the teeth 18 are beveled but the upper surface of the teeth 18 are flat. This configuration enables the teeth 18 to deform under compacting pressure so that they disengage an outer notch 20 and then engage an inner notch 26 such that the overall length of the tumbler is reduced. This reduction is irreversible. The shape of the teeth do not allow the shortened tumblers to revert to their extended non compacted configurations. In some embodiments, not shown, there are more than one inner notches 26. In such embodiments, the tumbler may assume more than one compacted length.

Unlike the components in prior art DE 202004015051 and European patent number EP0763639 described hereinabove, which describe compressible tumblers, the compactable lock component $\mathbf{10}_1$ is designed such that application of a compacting force causes the overall length of the compactable tumbler $\mathbf{10}_1$ to change, such that the tumbler assumes a shortened configuration and is locked into this configuration. The distal component 12 and proximal component 14 may be fabricated from any suitable resilient metal, such as brass, for example, where the Young's modulus enables the teeth 18 to be bent inwards slightly to allow the pin to be compacted, but on compaction, the teeth 18 spring out into the inner notch 26, and lock in place.

Figure 4:
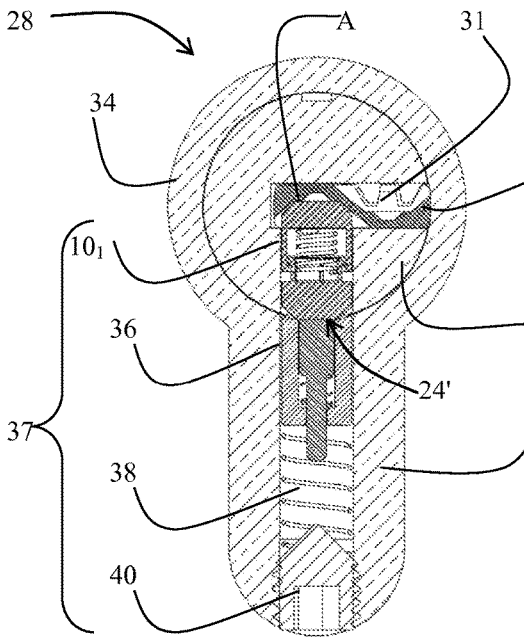
FIG. 4 is a sectional view of a lock showing a cylinder (also known as rotor, or plug) in the barrel of a stator (housing), and a tumbler system that includes the compactable tumbler. Also shown is part of a key in the keyway, such that a dimple is aligned with the compactable tumbler and receives the end of the compactable lock element, resulting in the cylinder being able to turn within the barrel.

With reference to FIG. 4, a section through a lock 28 showing a cylinder or cylinder 32 in the barrel 34 of a stator (housing) 35, and a bore 37 that includes a tumbler $\mathbf{10}_1$ within the cylinder part, a distal driver pin 36 substantially within the part of the bore extending into the stator, a resilient spring 38 and a plug 40, to enable the cylinder to turn within the barrel, the tumbler and driver pin must be aligned such that the connecting edge between them is at the shear line between the cylinder and barrel.

Also shown is part of a key 30 in the keyway 31, such that a dimple A is aligned with the compactable lock element $\mathbf{10}_1$ and receives one end 24 of the compactable tumbler $\mathbf{10}_1$. The length $X_1$ of the compactable tumbler $\mathbf{10}_1$ is such, that the other end 24' of the compactable tumbler $\mathbf{10}_1$ is aligned with the shear line, i.e. the join between cylinder 32 and barrel 34, with the distal lock element, i.e. the driver pin 36 is wholly within the housing 35. The retaining spring 38 is held in place by the plug 40 and supports the compactable tumbler $\mathbf{10}_1$ and driver pin 36, such that the compactable tumbler $\mathbf{10}_1$ is pushed against the key 30. The dimple A in key 30 is aligned with the compactable driver $\mathbf{10}_1$ and receives one end 24 of the compactable driver $\mathbf{10}_1$, resulting in the tumbler $\mathbf{10}_1$ lying completely within the cylinder 32, and since neither tumbler $\mathbf{10}_1$ nor driver 36 span across the shear line, i.e. the outer edge of cylinder 32, cylinder 32 is able to turn within the barrel 34.

Figure 5:
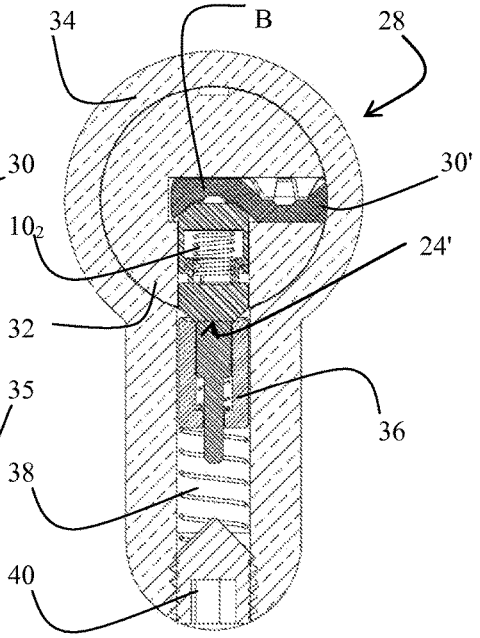
FIG. 5 shows a sectional view of the lock of FIG. 4, wherein a key with a shallow dimple is inserted into the keyway, causing the compactable tumbler to extend into the bore within the stator of the lock.

With reference to FIG. 5, a section through the lock 28 is shown, mutatis mutantis, wherein a key 30' having a shallower dimple B is provided. Consequently, the proximal end 24 of the compactable tumbler $\mathbf{10}_1$ does not sit so high up in the keyway 31, and the distal end 24' of the compactable tumbler $\mathbf{10}_1$ protrudes beyond the cylinder 32 into the barrel 34 of the stator, pushing the distal driver pin 36 against the compressed spring 38 supported by the plug 40.

In FIG. 5, due to the shallower dimple B of key 30' not allowing the proximal end 24 of the compactable tumbler $\mathbf{10}_1$ to sit so highly in the keyway 31, the distal end 24' of the compactable tumbler $\mathbf{10}_1$ extends beyond the cylinder 32, into the cylinder block 2. Consequently, the cylinder 32 is prevented from rotating in barrel 34 by the protruding distal end 24' of the compactable tumbler $\mathbf{10}_1$.

Figure 6:
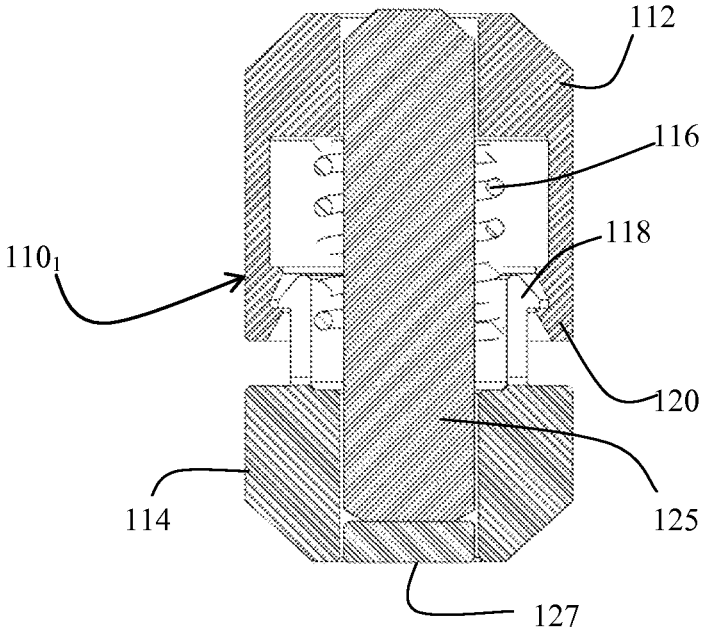
FIG. 6 shows a modified compactable tumbler its extended state, the modified tumbler having an inner pin. Also shown is a filling disk.

With reference to FIG. 6, a modification of compactable tumbler $\mathbf{10}_1$ is shown. Modified compactable tumbler $\mathbf{110}_1$ consists of an upper part 112 and a lower part 114 that are coupled together around a compressed spring 116. One of the upper part 112 and lower part 114 is provided with teeth 118 and the other of upper part 112 and lower part 114 is provided with a notch 120. The teeth 118 engage notch 120. As shown, the teeth 118 are provided as integral with lower part 114 and the notch 120 with the upper part 112, i.e. the lower part 114 is the male part and the upper part 112 is the female part. It will be appreciated, however, that the teeth 118 could be provided on the upper part 112, and the notch 120 on the lower part 114.

Modified compactable tumbler $\mathbf{110}_1$ is an outer pin or sleeve, having an inner pin 125 or insert. Inner pin 125 is shorter than modified compactable tumbler $\mathbf{110}_1$ and a filling disk 127 is provided.

Figure 7:
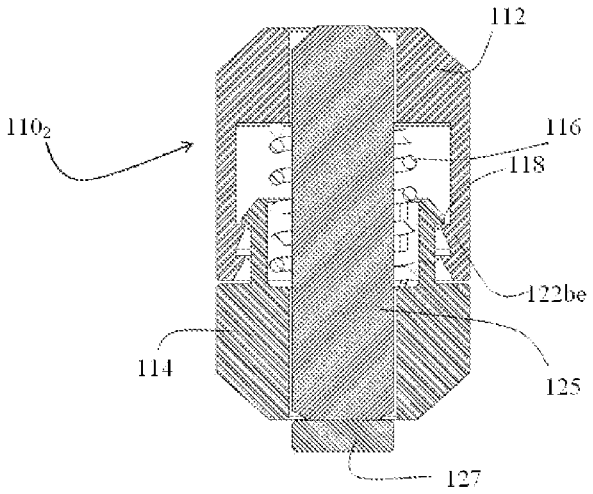
FIG. 7 shows the modified compactable tumbler of FIG. 6, in its compacted state, ejecting the filling disk.

With reference to FIG. 7, the modified compactable tumbler 110 is shown in its compacted state $\mathbf{110}_2$. The lower part 114 is squeezed into the upper part 112 such that teeth 118 of lower part 114 engage an inner notch 122 on the upper part 112. Thus modified compactable lock element 110 in its compacted state $\mathbf{110}_2$ is shorter than in its non compacted state $\mathbf{110}_1$. Overall length of compacted modified compactable tumbler $\mathbf{110}_2$ is the same as the length of the inner pin 125, so squeezing the compactable tumbler $\mathbf{110}_1$ ejects the filling disk 127.

Figure 8:
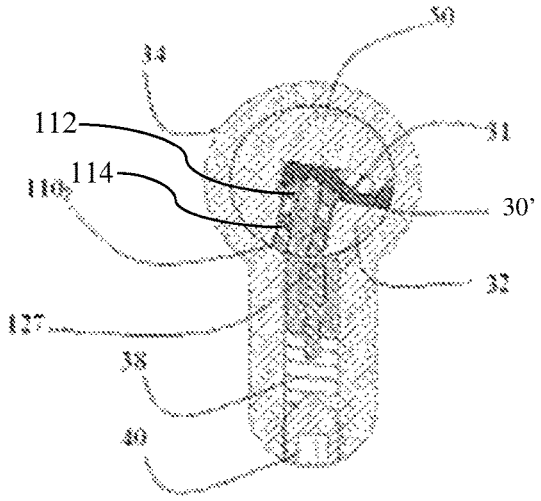
FIG. 8 shows the modified compactable tumbler of FIG. 7 within the cylinder of a lock, with a key in the keyway, the key having a shallow dimple, such that the filling disk is transferred from the compactable tumbler to the bore extending into the barrel, and remains within the barrel as the cylinder is turned by the key.

With reference to FIG. 8, if a key 30' with a shallow dimple B is inserted into key way 31 of the modified compactable tumbler 110 and rotated slightly, the beveled edge 22 of the lower section 114 presses against the barrel 34, and the lower section 114 is pushed into the upper section 112, such that the compactable tumbler 110 moves from its non-compacted state $\mathbf{110}_1$ to its compacted state $\mathbf{110}_2$, with teeth 118 engaging inner notch 122 (see e.g.,FIG. 7).

Figure 9:
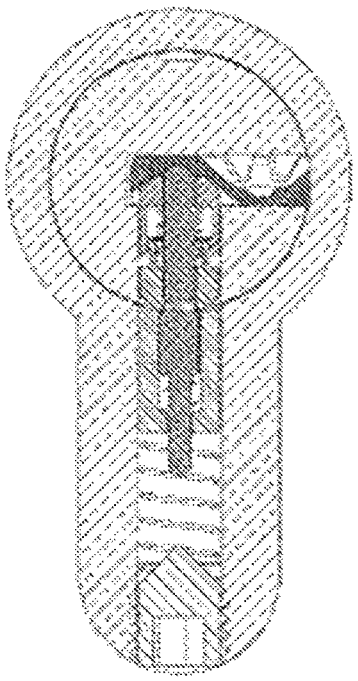
FIG. 9 is a section through a lock and key showing the modified compactable tumbler in its non-compacted state with the filing disk within the tumbler, with a key having a deep dimple.
Figure 10:
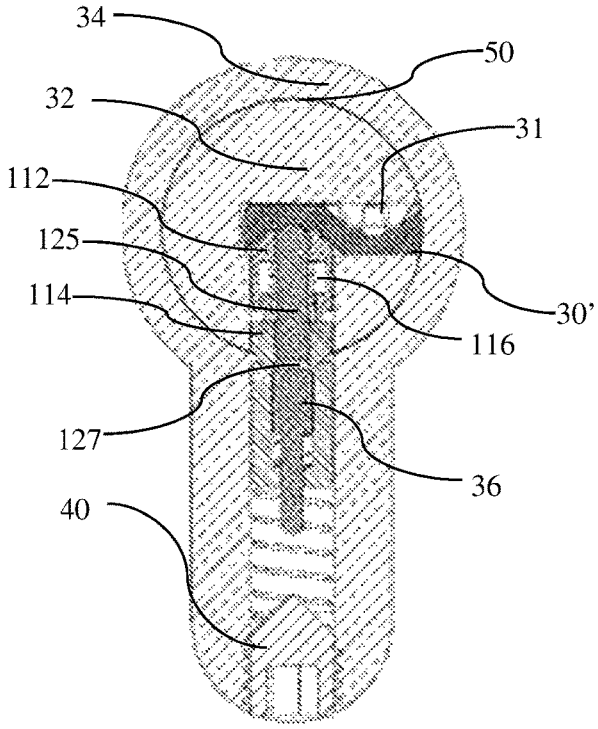
FIG. 10 is a section through a lock and key showing the modified compactable tumbler in its compacted state, with a key having a deep dimple causing the modified compactable tumbler to compact, ejecting the filling disk from the modified compacted tumbler into the bore.

In this manner, with reference to FIG. 9, the lock with compactable tumbler $\mathbf{110}_1$ is compatible with a key 30 with a deep dimple A, and can be used to open and close the lock in a normal fashion. However, referring to FIG. 10, if a key 30' with a shallow dimple B is inserted in the keyway 31, the filling disk 127 is ejected into the bore, and rotating the key causes the compactable tumbler $\mathbf{110}_1$ to compact, assuming the compacted configuration $\mathbf{110}_2$. Rotating the key 30 through 180° rotates the cylinder 32 through an appropriate preset angle, such as 180° which is the angle shown, and brings a socket 50 into alignment with the bore 37 of the tumbler. The compressed spring 38 forces driver pin 36 to eject the filling disk 127 into the socket 50.

In this manner, the tumbler of the lock 28 shown is reconfigured from one that is openable by a deep dimple A, to one that may be opened by a shallow dimple B. In other words, the key that opens the lock 28 is changed.

It will be appreciated that a lock may have any number of tumbler assemblies and typically has from 2 to 10 tumbler assemblies, each in its own bore. Any or all of these may be configured with a compactable tumbler $\mathbf{110}_1$ that enables the key required to open the lock to be changed.

Thus the lock and key combination of a lock including one or more compactable tumblers $\mathbf{110}_1$ may be changed one or more times by changing the key and turning it, without requiring additional tools, or specialist lock skills, simply by changing the key.

Although described for a dimpled key, it will be appreciated that the compactable lock element described hereinabove and the corresponding method of changing the lock and cylinder combination may be adapted for a jagged flat key or for a key with a cylindrical shaft.

Several embodiments of the present invention have been described. Nevertheless, it will be understood that various modifications may be made without departing from the spirit and scope of the invention. Accordingly, other embodiments are within the scope of the following claims.

Thus persons skilled in the art will appreciate that the present invention is not limited to what has been particularly shown and described hereinabove. Rather the scope of the present invention is defined by the appended claims and includes both combinations and sub combinations of the various features described hereinabove as well as variations and modifications thereof, which would occur to persons skilled in the art upon reading the foregoing description.

In the claims, the word "comprise", and variations thereof such as "comprises", "comprising" and the like indicate that the components listed are included, but not generally to the exclusion of other components.

The invention claimed is:

1. A tumbler for positioning in a bore extending radially from a keyway in a lock for selectively engaging a feature of a key within the keyway, said tumbler comprising:

a) a male part that interlocks with a female part about a compressed spring; the male part having retaining teeth for selectively engaging an inner notch or an outer notch of the female part, such that when said retaining teeth engage the outer notch, the tumbler has a first configuration with an uncompressed overall length and on compression assumes a second configuration wherein the teeth of the male part engage the inner notch in the female part so that the overall length of the interlocked male and female parts is reduced, such that the change in length is irreversible; and b) an inner pin having a length equal to the combined length of the interlocked male and female parts when the teeth of the male part engage the inner notch of the female part and the interlocked male and female parts are compacted.

2. The tumbler of claim 1, wherein the female part has more than one inner notch, such that the interlocked male and female parts may assume a plurality of reduced overall lengths.

3. The tumbler of claim 1, wherein said male and female parts each have a flat surface parallel to the keyway and beveled edges around said flat surfaces.

4. The tumbler of claim 1, wherein the male part is fabricated from a stiff resilient material.

5. The tumbler of claim 4, wherein the stiff resilient material is a metal or alloy.

6. The tumbler of claim 5, wherein the teeth of the male part have outer tapered surfaces and lower flat surfaces and the metal or alloy of the male part has a Young's modulus such that the teeth may be forced inwards to enable the tumbler to be compacted, but the compaction is irreversible.

7. A lock assembly comprising the tumbler of claim 6, a driver pin, a spring and a plug, and further comprising a filling disk, such that in a non-compacted state, the inner pin and filling disk are positioned within the tumbler, but on compacting, the filling disk is expelled out of the tumbler into the bore.

8. The tumbler of claim 1, further comprising a filling disk, such that the filling disk and the inner pin have a combined length equal to the combined length of the male and female parts when the teeth of the male part engage the outer notch of the female part and the interlocked male and female parts are not compacted.

9. A lock comprising a cylinder configured to rotate within a barrel, and provided with a lock assembly within a bore; the lock assembly comprising a tumbler disposed perpendicular to a keyway, the tumbler comprising a male part that interlocks with a female part about a compressed spring; the male part having retaining teeth for selectively engaging an inner notch or an outer notch of the female part, such that when said retaining teeth engage the outer notch, the tumbler has a first configuration with an uncompressed overall length and on compression assumes a second configuration wherein the teeth of the male part engage the inner notch in the female part so that the overall length of the tumbler is reduced, such that the change in length is irreversible; an inner pin having a length equal to the combined length of the interlocked male and female parts when the teeth of the male part engage the inner notch of the female part and the tumbler is compacted; a driver pin, a spring and further comprising a filling disk, such that in a non-compacted state, the inner pin and filling disk are positioned within the tumbler, but on compacting, the filling disk is ejected out of the tumbler into the bore, such that inserting a key having a shallow dimple into the keyway and rotating causes the key having a shallow dimple to press against the tumbler, causing the tumbler to be compacted and the inner pin to expel the filling disk out of the tumbler and into the bore.

10. The lock of claim 9 further wherein the cylinder further comprising a socket on an opposite side of the cylinder from the bore, such that rotation of the cylinder through a preset angle causes the filling disk to be ejected out of the bore by the driver pin, and into the socket.

11. The lock of claim 10, wherein the preset angle is 180 degrees.

12. The lock of claim 10 further comprising additional compactable tumblers.

13. A method of changing a key and lock combination by providing the lock of claim 10, and inserting a key having at least one shallow dimple corresponding to a tumbler having a first lock component, and rotating the key to compact the first lock component, thereby ejecting the filling disk into the bore, such that on rotating the cylinder through the preset angle, the filling disk is transferred to the socket.

* * * * *